US007617694B2

(12) United States Patent
Hwang et al.

(10) Patent No.: US 7,617,694 B2
(45) Date of Patent: Nov. 17, 2009

(54) APPARATUS AND METHOD FOR CONTROLLING SUPER-HEATING DEGREE IN HEAT PUMP SYSTEM

(75) Inventors: Il Nahm Hwang, Ansan-si (KR); Young Min Park, Incheon-si (KR); Yoon Been Lee, Seoul (KR); Dong Jun Yang, Seoul (KR); Seok Ho Yoon, Seoul (KR); Jong Han Park, Gwangmyeong-si (KR); Sung Oh Choi, Gwangmyeong-si (KR); Sung Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 346 days.

(21) Appl. No.: 10/957,964

(22) Filed: Oct. 5, 2004

(65) Prior Publication Data

US 2005/0081539 A1 Apr. 21, 2005

(30) Foreign Application Priority Data

Oct. 17, 2003 (KR) ..... 10-2003-0072495

(51) Int. Cl.
*F25B 41/04* (2006.01)

(52) U.S. Cl. ..... 62/225; 62/126; 62/129; 62/160; 62/222; 62/324.1

(58) Field of Classification Search ..... 62/126, 62/225, 129, 160, 222, 228.1, 324.1
See application file for complete search history.

(56) References Cited

U.S. PATENT DOCUMENTS 5,241,833 A * 9/1993 Ohkoshi ..... 62/126
5,396,776 A * 3/1995 Kim ..... 62/115
5,987,907 A 11/1999 Morimoto et al.
6,032,473 A 3/2000 Morimoto et al.

(Continued)

FOREIGN PATENT DOCUMENTS

EP 1150076 10/2001

(Continued)

OTHER PUBLICATIONS

Thermodynamics: An Engineering Approach pages by Cenegel et al.*

(Continued)

*Primary Examiner*—Frantz F. Jules
*Assistant Examiner*—Azim Rahim
(74) *Attorney, Agent, or Firm*—McKenna Long & Aldridge LLP

(57) ABSTRACT

Provided is an air conditioner, particularly, an apparatus and method for controlling a super-heating degree in a heat pump system for preventing a liquid refrigerant from flowing into a compressor. The method includes: operating the heat pump system; receiving a present outdoor temperature, a pipe absorption temperature and a low pressure value of a compressor, respectively; computing a present absorption super-heating degree from a difference between the absorption temperature of the compressor and a saturated temperature at a low pressure side; and comparing an targeted absorption super-heating degree set in advance, with the computed present absorption super-heating degree according to the received outdoor temperature, and controlling the system so that the present absorption super-heating degree may follow the targeted absorption super-heating degree.

14 Claims, 9 Drawing Sheets

U.S. PATENT DOCUMENTS

| | | | | |
|---|---|---|---|---|
| 6,109,533 | A | 8/2000 | Ao et al. | |
| 6,192,696 | B1 | 2/2001 | Shimamoto et al. | |
| 6,769,264 | B2 * | 8/2004 | Moon et al. | 62/204 |
| 6,951,116 | B2 * | 10/2005 | Lee et al. | 62/175 |
| 2001/0000050 | A1 * | 3/2001 | Okazaki et al. | 62/149 |
| 2002/0023448 | A1 | 2/2002 | Ito et al. | |

FOREIGN PATENT DOCUMENTS

| | | |
|---|---|---|
| EP | 0926454 | 2/2004 |
| JP | 8-14698 | 1/1996 |
| JP | 10-054628 | 2/1998 |
| KR | 0133044 | 3/1994 |

OTHER PUBLICATIONS

English language Abstract of JP 8-14698.
English language Abstract of JP 10-54628.
U.S. Appl. No. 10/958,123 to Oh et al., filed Oct. 5, 2004.

* cited by examiner

APPARATUS AND METHOD FOR CONTROLLING SUPER-HEATING DEGREE IN HEAT PUMP SYSTEM

BACKGROUND OF THE INVENTION

1. Field of the Invention

The present invention relates to an air conditioner, and more particularly, to an apparatus and method for controlling super-heating degree, capable of preventing liquid compression of a compressor.

2. Description of the Related Art

The air conditioner is an apparatus for adjusting temperature, humidity, airflow, and cleanness of an air to achieve pleasant indoor environment. Recently, a multi-type air conditioner capable of arranging a plurality of indoor units for each installation space and adjusting air temperature for each installation space has been developed.

A heat pump system makes it possible to use a combined cooling system and heating system by using a cooling cycle principle for flowing a refrigerant through a normal channel and a heating cycle principle for flowing a refrigerant in reverse direction.

FIG. 1 shows a general cooling cycle and its relation on the Mollier chart. As shown in FIG. 1, in a cooling cycle, compression→liquidation→expansion→evaporation of a refrigerant are repeatedly performed.

A compressor 10 compresses an absorbed refrigerant and discharges a super-heated vapor of high temperature and high pressure, into an outdoor heat exchanger 15. At this time, the state of the refrigerant discharged from the compressor 10 is changed into a gas state of superheating degree beyond the saturated state on the Mollier chart.

The outdoor heat exchanger 15 generates a phase change of the refrigerant into a liquid state by exchanging heat from the refrigerant of high temperature and high pressure discharged from the compressor 10, with outdoor air. At this time, the refrigerant is rapidly lowered in its temperature by being deprived of its heat by air passing through the outdoor heat exchanger 15 and delivered as a liquid state of super-cooling degree.

Subsequently, an expansion apparatus 20 adjusts the refrigerant into a state where evaporation easily occurs in an indoor heat exchanger 25, by decompressing the refrigerant super-cooled at the outdoor heat exchanger 15.

In the meantime, an indoor heat exchanger 25 exchanges heat of the refrigerant that has been decompressed at the expansion apparatus 20, with heat of an outdoor air. At this time, the refrigerant is raised in its temperature by absorbing heat from an air passing through the indoor heat exchanger, whereby the phase of the refrigerant is changed into a gas state.

Also, the refrigerant absorbed to the compressor 10 from the indoor heat exchanger 25 becomes a gas state of super-heating degree (SH) that has evaporated beyond the saturated state.

From the above relation between the cooling cycle and the Mollier chart, it is understood that the refrigerant passes through the compressor 10, the outdoor heat exchanger 15, the expansion apparatus 20, the indoor heat exchanger 25, and goes back to the compressor 10.

Also, the refrigerant is changed in its phase into the state of the super-heating degree during the process that the refrigerant is delivered to the compressor 10 from the indoor heat exchanger 25. Namely, the refrigerant absorbed to the compressor 10 or discharged from the compressor 10 should be a complete gas state.

However, the foregoing is a theoretical result, and generally, an error occurs to some extent upon application of the system to an actual product. Furthermore, in case an amount of the refrigerant flowing on the cooling cycle is relatively large or small compared to the state heat-exchanged, the phase change at above each process is not complete.

Due to such a problem, the refrigerant absorbed from the indoor heat exchanger 25 to the compressor 10 may not be completely phase-changed into the super-heated vapor and still exit in the liquid state. When the refrigerant in the liquid state is accumulated in an accumulator (not shown) and then absorbed into the compressor 10, noise is increased and performance of the compressor is deteriorated.

Also, when a heating mode is switched into a defrosting mode or a defrosting mode is switched into a heating mode in the heat pump system, there is high possibility that the refrigerant in the liquid state is absorbed into the compressor 10. Such a phenomenon occurs as the refrigerant flow changes when the heat exchanger that has operated as the indoor heat exchanger operates as a condenser and, reversely, the heat exchanger that has operated as the outdoor heat exchanger operates as an evaporator during the mode switching process.

Also, the air conditioner according to the related art prevents the refrigerant in the liquid state from being excessively accumulated in the accumulator and being absorbed into the compressor, by adjusting the refrigerant flowing amount using the expansion apparatus 20 and getting the refrigerant absorbed to the compressor 10 to have a super-heating degree. Here, the expansion apparatus 20 includes LEV (Linear Electronic Expansion Value) or EEV (Electronic Expansion Valve), and is referred to as EEV hereinafter.

The air conditioner according to the related art, however, has the following problems.

When adjusting the refrigerant flow rate by controlling the expansion apparatus so that the difference between the discharging temperature of the compressor and the evaporating temperature of the outdoor heat exchanger may be maintained constant during the switching process between the heating mode and the defrosting mode, the liquid refrigerant may flow into the compressor, which is problematic.

Namely, for mode switching, switching by the 4-way valve is performed. At this time, if the compressor is operated simultaneously with mode switching, circulation direction of the refrigerant is reversed and the possibility that the liquid refrigerant is absorbed into the compressor gets increased.

Therefore, when the liquid refrigerant is absorbed into the compressor, there occurs a problem that the reliability of the product is lowered due to deterioration in performance of the compressor and noise generation.

Also, as the outdoor temperature is lowered, the difference between the temperature of the outdoor air and the temperature of the outdoor heat exchanger gets decreased, whereby heat exchange amount at the outdoor heat exchanger decreases and the liquid refrigerant amount accumulated in the accumulator increases and the possibility that the liquid refrigerant is absorbed into the compressor gets large. Such phenomenon acts as a factor that lowers reliability of the heat pump system.

Also, according to the related art, since response characteristics of the system depending on change of one degree in the absorbed temperature, gets very large, for control of the absorption super-heating degree, very accurate pressure sensor and temperature sensor are required.

Also, since the temperature computed on the basis of the high-saturated pressure is used for the reference for control of the discharging super-heating degree, the pressure at the lower pressure part and the refrigerant circulation amount are not considered, whereby an error increases, which is problematic.

SUMMARY OF THE INVENTION

Accordingly, the present invention is directed to an apparatus and method for controlling a super-heating degree in a heat pump system that substantially obviates one or more problems due to limitations and disadvantages of the related art.

An object of the present invention is to provide a method for controlling a super-heating degree in a heat pump system, which enables an absorption super-heating degree of a compressor to be varied with change of an outdoor temperature.

Another object of the present invention is to provide an apparatus and method for controlling a super-heating degree in a heat pump system, which enables an absorption super-heating degree to be increased as an outdoor temperature falls to a low temperature.

Still another object of the present invention is to provide an apparatus and method for controlling a super-heating degree in a heat pump system, capable of controlling a discharging super-heating degree using, for the reference, a computed value of a reversible pressure computed on the basis of low and high pressures of a compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for controlling a super-heating degree in a heat pump system. The method includes: operating the heat pump system; receiving a present outdoor temperature, a pipe absorption temperature and a low pressure value of a compressor, respectively; computing a present absorption super-heating degree from a difference between the absorption temperature of the compressor and a saturated temperature at a low pressure side; and comparing a targeted absorption super-heating degree set in advance with the computed present absorption super-heating degree according to the received outdoor temperature, and controlling the system so that the present absorption super-heating degree may follow the targeted absorption super-heating degree.

In another aspect of the present invention, there is provided a method for controlling a super-heating degree in a heat pump system. The method includes: operating the heat pump system; receiving a low and a high pressures at a low pressure and a high pressure parts of a compressor, and a discharging temperature of the compressor, respectively; computing an absorption temperature of the compressor from a saturated temperature of a refrigerant at a low pressure side, and computing a reversible compression point from a result of a reversible compressing process to a high pressure side using the computed absorption temperature of the compressor, for a starting point; computing a present discharging super-heating degree from a difference between a reversible compression temperature on a reversible compression point and the received discharging temperature of the compressor; and controlling the system so that the present discharging super-heating degree of the compressor may remain within a predetermined range.

In another aspect of the present invention, there is provided an apparatus for controlling a super-heating degree in a heat pump system. The apparatus includes: one or more indoor units; one or more outdoor units each including a compressor, a channel switching valve for selectively switching a channel of a refrigerant depending on a cooling and a heating modes, an outdoor heat exchanger for exchanging heat with an outdoor air, and an outdoor EEV (Electronic Expansion Valve); a low and a high pressure sensors for detecting a low and a high pressure of the compressor, respectively; a discharging pipe temperature sensor for detecting a discharging temperature of the compressor; an absorption temperature detecting means for computing an absorption temperature of the compressor using a saturated temperature of the refrigerant used and an absorption super-heating degree from the detected low pressure value of the compressor; a discharging super-heating degree detecting means for computing a reversible compression temperature by a reversible compressing process and a discharging temperature at a high pressure side of the compressor, from the absorption temperature of the compressor, and computing a present discharging super-heating degree; and a controlling means for comparing the present discharging super-heating degree computed by the discharging super-heating degree detecting means, with a targeted discharging super-heating degree set in advance, then controlling the system so that the present discharging super-heating degree may follow the targeted discharging super-heating degree.

The present invention sets the targeted absorption super-heating degree to prevent inflow of the liquid refrigerant, depending on change of the outdoor temperature, then gets the present absorption super-heating degree to follow the targeted absorption super-heating degree according to the outdoor temperature, thereby minimizing inflow of the liquid refrigerant to the compressor.

Also, the present invention computes the absorption temperature by compensating for the absorption super-heating degree, with respect to the saturated temperature computed from the low pressure sensor of the compressor, then controls in such a way that a discharging super-heating degree that corresponds to the difference between the reversible compression temperature and the discharging temperature, may remain within an targeted range, thereby improving system reliability through accurate control.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings A method for controlling a super-heating degree in an air conditioner according to the present invention will be described with reference to the accompanying drawings in the following.

First Embodiment

Figure 1:
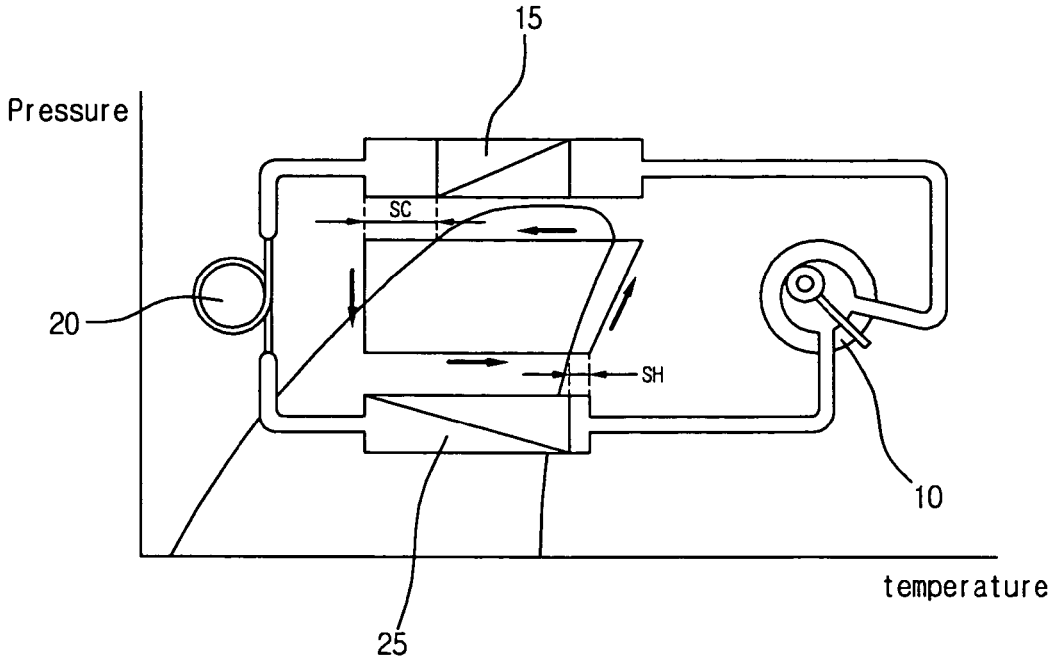
Fig.1 Related Art
FIG. 1 is a structural view showing an operating cycle of the general air conditioner.
Figure 2:
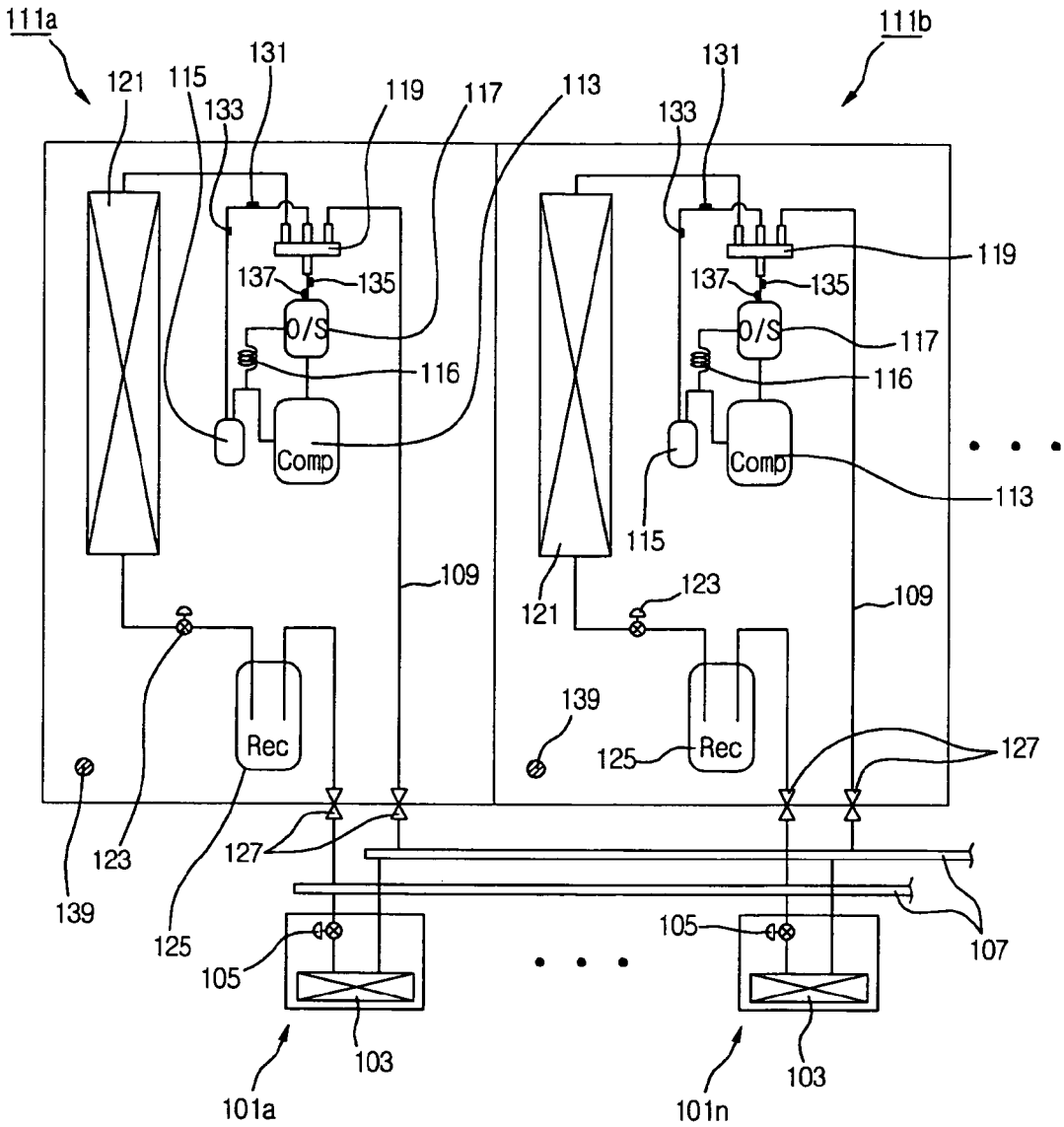
FIG. 2 is a structural view of a multi-type air conditioner for controlling an absorption super-heating degree according to a first embodiment of the present invention.

FIGS. 2 through 5 show a first embodiment of the present invention. Specifically, FIG. 2 is a structural view showing a multi-type air conditioner for use in both heating and cooling according to the first embodiment of the present invention.

Referring to FIG. 2, one or more outdoor units 111*a* and 111*b*, one or more indoor units 101*a* through 101*n*, and a refrigerant pipe 109 through which the refrigerant may flow between the indoor unit and the outdoor unit, are provided.

The indoor unit 101*a* through 101*n* includes an indoor heat exchanger 103 and an indoor EEV 105. To the outdoor of the indoor unit 101*a* through 101*n*, a refrigerant manifold 107 for inflow and outflow of the refrigerant is connected.

The indoor heat exchanger 103 selectively performs cooling and heating for the indoor space by exchanging heat with an indoor air by means of an indoor fan (not shown), operating as an evaporator in the cooling mode, and operating as a condenser in the heating mode. The indoor EEV 105 decompression-expands the refrigerant that flows into the indoor heat exchanger 103.

Also, the outdoor unit 111*a* and 111*b* includes a compressor 113, a channel switching valve 119, an outdoor heat exchanger 121, and an outdoor EEV 123.

One or more compressors 113 are installed for each outdoor unit 111*a* and 111*b* depending on load capacity, and compress the absorbed refrigerant with high temperature and high pressure, and discharge the same. For the channel switching value 119, a 4-way valve is generally used. The channel switching valve 119 switches the channel so that the refrigerant discharged from the compressor 113 may flow to the outdoor heat exchanger 121 or to the indoor heat exchanger 103 according to the operation mode (the cooling mode or the heating mode).

Here, to the absorption side of the compressor 113, an accumulator 115 is connected so that the refrigerant of a gas phase may be absorbed to the compressor 113, and to the discharging side of the compressor 113, an oil separator 117 (O/S) for separating an oil is connected. To the outflow side of the oil separator 117, the channel switching valve 119 is provided, and a capillary tube 116 is connected between the oil separator 117 and the accumulator 115.

Also, a plurality of accumulators 115 and oil separators 117 may be installed depending on load capacity of the compressor 113.

The outdoor heat exchanger 121 exchanges heat with an outdoor air by means of an outdoor fan (not shown), operating as a condenser in the cooling mode, and operating as an evaporator in the heating mode. The outdoor EEV 123 decompression-expands the refrigerant that flows into the outdoor heat exchanger 121.

On one side of the outdoor EEV 123, a receiver tank 125 is installed, and a service valve 127 is formed between the outdoor unit 111*a*, 111*b* and the manifold 107, for communication with the outside.

In the meantime, to an absorption side of the compressor 113, an absorption pipe temperature sensor 133 and a low pressure sensor 131 for measuring the temperature and the low pressure of the absorption pipe are provided, respectively. Here, the absorption pipe temperature sensor 133 and the low pressure sensor 131 are preferably installed on the refrigerant pipe in the absorption side of the accumulator 115.

Also, on the discharging side of the compressor 113, a discharging pipe temperature sensor 137 and a high pressure sensor 135 for measuring the temperature and the high pressure of the discharging pipe, are installed, respectively. Here, the discharging pipe temperature sensor 137 and the high pressure sensor 135 are preferably installed between the oil separator 117 and the channel switching valve 119.

Also, inside the installation space of the outdoor unit 111*a* and 111*b*, outdoor temperature sensors 139 for measuring an outdoor temperature are installed, respectively.

If the multi-type air conditioner operates in the cooling modes, the refrigerant of high temperature and high pressure, compressed by the compressor 113 flows into the outdoor heat exchanger 121 through the channel switching valve 119. The outdoor heat exchanger 121 condenses the refrigerant compressed with high temperature and high pressure, into a state of low temperature and high pressure through heat exchange with an outdoor air. The condensed refrigerant is decompression-expanded by the indoor EEV 105, and is heat-exchanged with an indoor air by the indoor heat exchanger 103, whereby the indoor space is cooled. Also, the refrigerant that has evaporated through the indoor heat exchanger 103, is absorbed again into the compressor 113, thereby operating in a cooling cycle.

If the multi-type air conditioner operates in the heating mode, the refrigerant of high temperature and high pressure, compressed by the compressor 113 is delivered to the indoor heat exchanger 103 by way of the channel switching valve 119, to heat the indoor space through heat exchange with an indoor air. The refrigerant condensed by the indoor heat exchanger 103 is decompression-expanded by an outdoor EEV 123, and evaporated due to heat exchange with an outdoor air when passing through the outdoor heat exchanger 121, and delivered again to the compressor 113, thereby operating in a heating cycle.

As described above, it is possible to selectively control the multi-type air conditioner for use both in cooling and heating, to operate in the cooling or the heating mode, and it is also possible to control the system to operate in the cooling mode or the heating mode for a separate indoor space.

If the air conditioner operates in the heating mode, the outdoor heat exchanger 121 operates as an evaporator. As the outdoor temperature is low, the difference between the outdoor heat exchanger 121 and the outdoor temperature reduces, and a heat exchange amount at the outdoor heat exchanger 121 gets reduced.

If the heat exchange amount at the outdoor heat exchanger 121 reduces, the liquid refrigerant amount accumulated at the accumulator 115 is increased, which may cause damage of the compressor.

For that purpose, control of an absorption super-heating degree (SH) for maintaining the refrigerant absorbed to the compressor 113 in a super-heated state, is performed. Control of the absorption super-heating degree (SH) is performed by adjusting an openness of the outdoor EEV 123 so that the refrigerant absorbed into the compressor may be absorbed in the gas state.

Namely, if the outdoor temperature is lower than a predetermined temperature, the openness of the outdoor EEV 123 is relatively reduced, and if the outdoor temperature is higher than a predetermined temperature, the openness of the outdoor EEV 123 is relatively increased.

Figure 3:
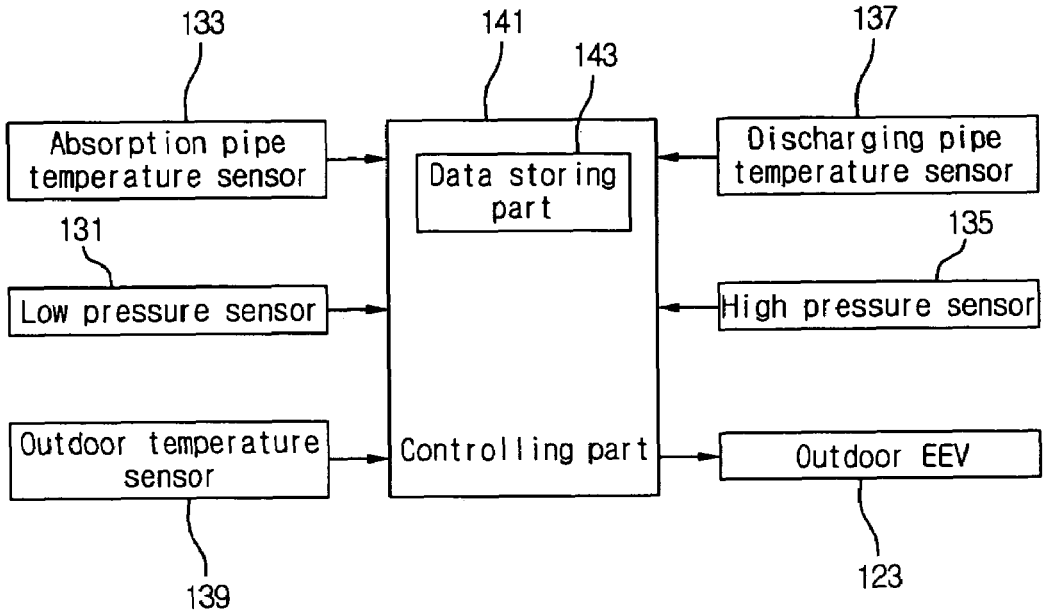
FIG. 3 is a structural view of a system control according to the first embodiment of the present invention.

FIG. 3 a block diagram for control of the super-heating degree. As shown in FIG. 3, a controlling part 141 receives the present absorption temperature and a discharging temperature, respectively, from the absorption pipe and the discharging pipe temperature sensors 133 and 137, and receives the present low and high pressures, respectively, from the low and the high pressure sensors 131 and 135. Also, the controlling part 141 receives the present outdoor temperature from the outdoor temperature sensor 139.

At this time, the controlling part 141 computes the present absorption super-heating degree (SH) using the absorption temperature and the low pressure, and computes the present discharging super-heating degree (SC) using the discharging temperature and the high pressure. Namely, the absorption super-heating degree is obtained as a difference between the saturated temperature of the refrigerant used, in low pressure and the present absorption temperature, and the discharging super-heating degree is obtained as a difference between the saturated temperature of the refrigerant used, in high pressure and the present discharging temperature.

Also, a data storing part 143 of the controlling part 141 stores a targeted absorption super-heating degree and a targeted discharging super-heating degree for each operation condition and control data that corresponds to an openness amount of the outdoor EEV 123 according to the super-heating degree.

The targeted absorption super-heating degree (SH) is set differently depending on the outdoor temperature received from the outdoor temperature sensor 139. Preferably, as the outdoor temperature falls down to a low temperature, the targeted absorption super-heating degree is set to an increasing value.

Figure 4:
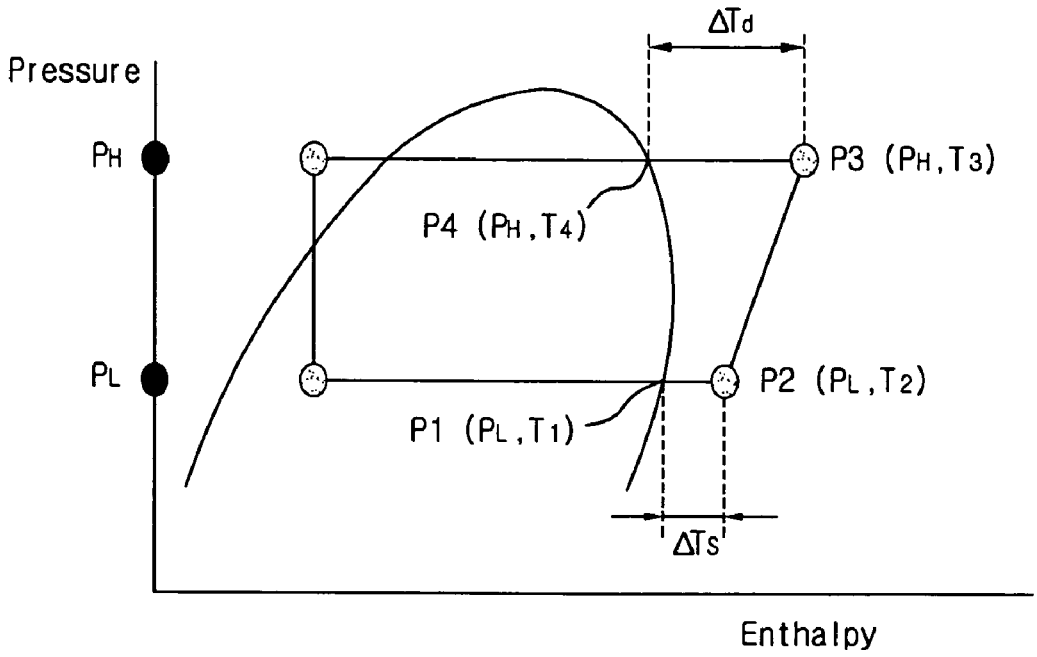
FIG. 4 is a p-h chart for controlling an absorption super-heating degree of the multi-type air conditioner according to the first embodiment of the present invention.

FIG. 4 is a Mollier chart for control of the absorption super-heating degree of the present invention. As shown in FIG. 4, a saturated point P1 and an absorption point P2 of the refrigerant used are obtained at the low pressure point detected by the low pressure sensor, and a saturated point P4 and a discharging point P3 are obtained at the high pressure point detected by the high pressure sensor.

At this time, if the low pressure $P_L$ and the saturated temperature T1 at the low pressure on the saturated point P1, and the low pressure $P_L$ and the present absorption temperature T2 on the absorption point P2, are obtained, the controlling part 141 computes the absorption super-heating degree $\Delta T_s$ using a value obtained by subtraction of the saturated temperature T1 from the present absorption temperature T2. Also, the present discharging super-heating degree ΔTd corresponds to a difference between the saturated temperature T4 of the refrigerant in high pressure and the present discharging temperature T3.

Also, the controlling part 141 controls the system so that the difference between the absorption temperature T2 of the compressor and the saturated temperature T1 of the refrigerant at the low pressure may be located within a predetermined range.

Namely, if the present absorption super-heating degree ΔTs is in agreement with the targeted absorption super-heating degree set in advance, it is judged that the liquid refrigerant does not flow into the compressor, and if the present absorption super-heating degree is not in agreement with the targeted absorption super-heating degree, it is judged that the liquid refrigerant may possibly flow into the compressor, and openness of the outdoor EEV 123 is adjusted. Therefore, the openness of the outdoor EEV 123 is adjusted so that the absorption temperature of the compressor may be more than a predetermined temperature, whereby the refrigerant amount flowing into the outdoor heat exchanger is controlled.

At this time, the controlling part 141 sets the targeted absorption super-heating degree to such value by which inflow of the liquid refrigerant may be prevented as much as possible, with consideration of variables such as a heat exchange amount of the outdoor heat exchanger, a temperature of the absorption pipe, according to the outdoor temperature.

Figure 5:
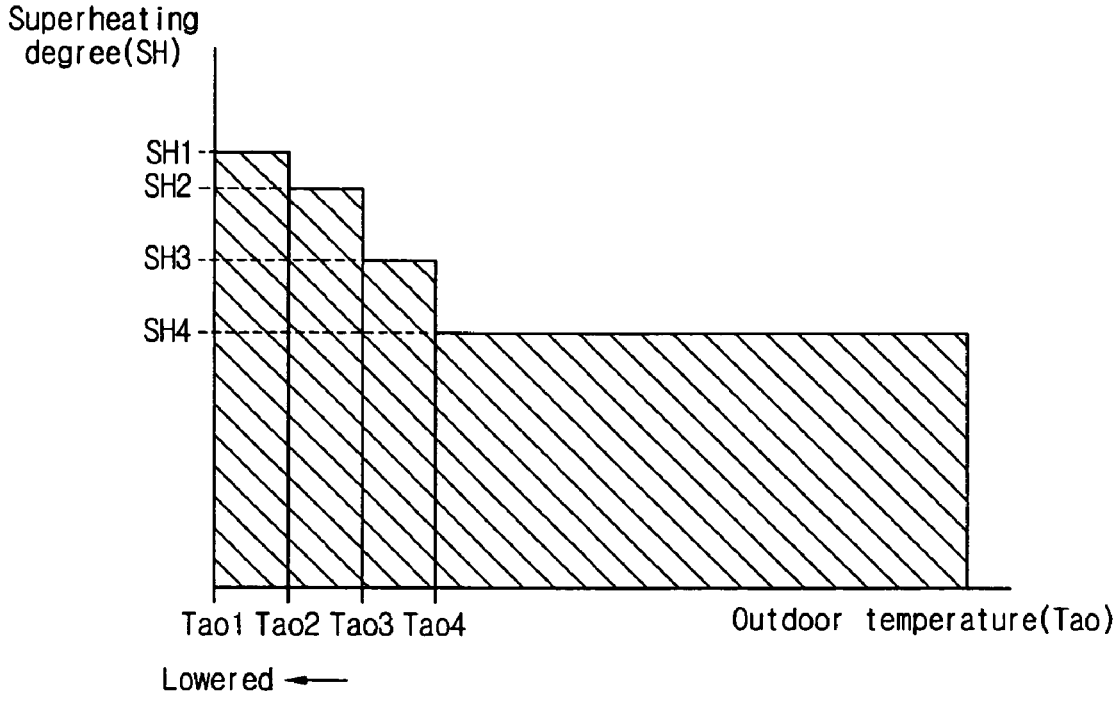
FIG. 5 is a graph showing relation between an outdoor temperature and an targeted absorption super-heating degree according to the first embodiment of the present invention.

More specifically, the targeted absorption super-heating degree (SH) is set to a relatively increased value as the outdoor temperature Tao is low as shown in FIG. 5, and set to a relatively reduced value as the outdoor temperature is high. Also, if the outdoor temperature is more than a predetermined temperature, the targeted absorption super-heating degree is fixed to a predetermined value.

Referring to FIG. 5, as the outdoor temperature Tao is lowered, the targeted absorption super-heating degree (SH) is set to a relatively increased value, the relation between the targeted absorption super-heating degree (SH) and the outdoor temperature is as follows, in which: SH1 (Tao1)>SH2 (Tao2)>SH3 (Tao3)>SH4 (Tao4) since the minimum outdoor temperature is Tao1 and the minimum targeted absorption super-heating degree is SH4.

Namely, if the outdoor temperature is more than Tao4, the relevant super-heating degree becomes SH4 which is the minimum targeted absorption super-heating degree, and if the outdoor temperature is more than Tao3, the relevant super-heating degree becomes SH3, and if the outdoor temperature is more than Tao2, the relevant super-heating degree becomes SH2, and if the outdoor temperature is more than Tao1, the relevant super-heating degree becomes SH1.

Here, it is possible to divide the outdoor temperature into a several range, with a constant interval, from below a predetermined temperature, and it is possible to differently set the targeted absorption super-heating degree to those values such as the minimum targeted absorption super-heating degree capable of preventing inflow of the liquid refrigerant, the maximum targeted absorption super-heating degree, and values positioned between the minimum and the maximum targeted absorption super-heating degree, depending on the outdoor temperature.

Also, the outdoor temperature is in reverse proportion to the targeted absorption super-heating degree, and the targeted absorption super-heating degree may not increase in a constant rate according to the lowering rate of the outdoor temperature. For example, it is possible to differently set the temperature distribution between the outdoor temperatures Tao3 and Tao2 depending on the environment.

The openness of the outdoor EEV 123 is increased or decreased depending on the outdoor temperature so that such targeted absorption super-heating degree may be in agreement with the present-absorption super-heating degree.

At this time, if the openness of the outdoor EEV 123 is reduced, a flowing refrigerant amount is reduced and difference between high pressure and low pressure of the refrigerant is increased, and if the flowing refrigerant amount is reduced, drying degree of the refrigerant flowing out from the outdoor heat exchanger is increased. As the drying degree of the refrigerant at the outflow side of the outdoor heat exchanger is increased; an amount of the liquid refrigerant accumulated at the accumulator is reduced. Accordingly, the possibility that the liquid refrigerant flows into the compressor is remarkably reduced. At this time, the present absorption super-heating degree is smaller than the targeted absorption super-heating degree.

Also, if the present absorption super-heating degree is greater than the targeted absorption super-heating degree, the openness of the outdoor EEV 123 is increased, whereby the present absorption super-heating degree follows the targeted absorption super-heating degree and reaches the targeted value.

The targeted absorption super-heating degree for each outdoor temperature band becomes a value that corresponds to the adjusted value of the outdoor EEV's openness for preventing, as much as possible, the liquid refrigerant from being accumulated at the accumulator due to the outdoor temperature.

Figure 6:
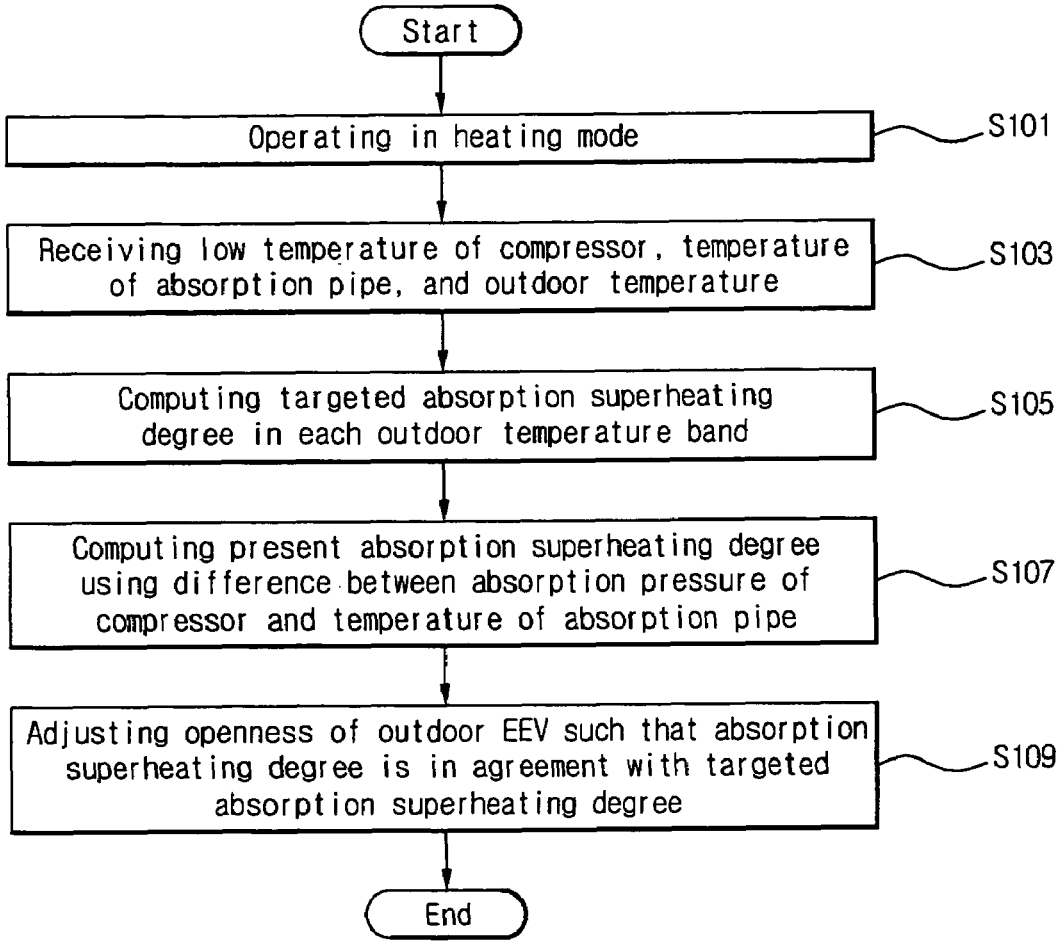
FIG. 6 is a flowchart showing a method for controlling an absorption super-heating degree according to the first embodiment of the present invention.

FIG. 6 is a flowchart showing a method for controlling a super-heating degree according to the first embodiment of the present invention.

Referring to FIG. 6, if the heat pump system starts to operate (S101), the system receives an absorption temperature from the absorption pipe temperature sensor of the compressor, a low pressure from the low pressure sensor, and the present outdoor temperature from the outdoor temperature sensor (S103).

At this time, the targeted absorption super-heating degree set in advance is computed according to the present outdoor temperature detected by the outdoor temperature sensor (S105).

Also, with use of the difference between the absorption pressure saturated temperature of the compressor and the absorption pipe temperature, the present absorption super-heating degree is computed (S107). After that, the openness of the outdoor EEV is adjusted so that the above computed present absorption super-heating degree may be in agreement with the targeted absorption super-heating degree (S109).

The operation of S109 is performed in the following way, in which: if the openness of the outdoor EEV is reduced, the refrigerant flowing amount is reduced, and the outdoor heat exchanger connected to the outdoor EEV, exchanges heat with respect to the refrigerant amount that is relatively reduced and drying degree is possibly increased so that the state of the refrigerant changes into a gas state. Accordingly, the refrigerant that has passed through the outdoor heat exchanger flows into the accumulator through the channel switching valve, whereby the liquid refrigerant accumulated at the accumulator gets reduced. Therefore, if the outdoor temperature is low, it is possible to remarkably improve the system reliability upon operation of the heat pump in the heating mode.

The above described first embodiment adjusts the openness of the outdoor EEV, using a low pressure, an absorption temperature, an outdoor temperature which are absorption super-heating degree variables, so that the present absorption super-heating degree that is the difference between the saturated temperature of the refrigerant used, computed from the low pressure value measured above and the temperature of the refrigerant absorbed to the compressor, may follow the targeted absorption super-heating degree which is varied depending on the outdoor temperature.

Second Embodiment

FIGS. 7 through 10 show the second embodiment of the present invention.

The second embodiment of the present invention is a method for controlling a discharging super-heating degree, and same reference numeral is used for the same parts as the multi-type air conditioner for use in both cooling and heating as shown in FIG. 2. The difference is that the second embodiment of the present invention does not use the absorption pipe temperature sensor but controls a discharging super-heating degree.

Figure 7:
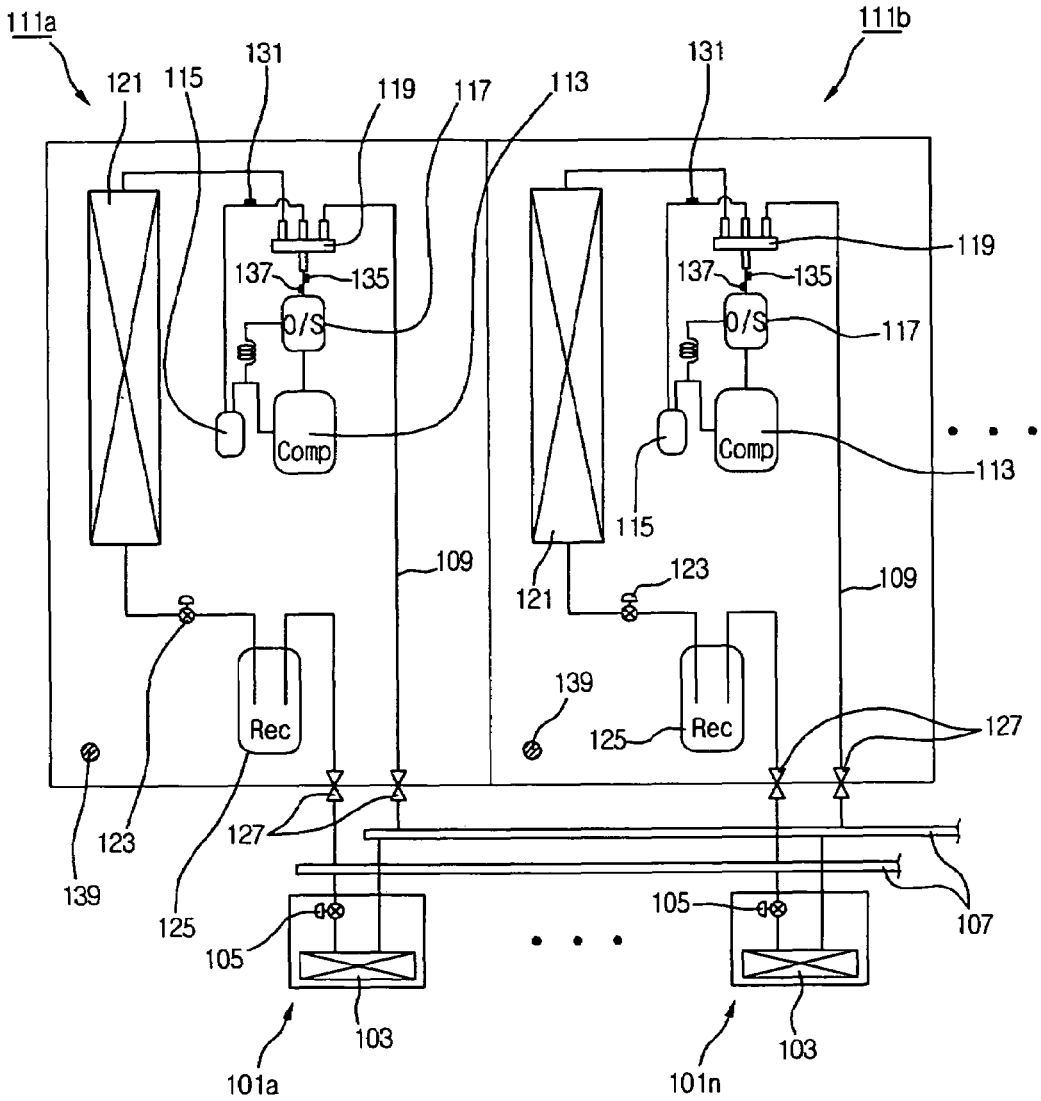
FIG. 7 is a structural view of the multi-type air conditioner for controlling a discharging super-heating degree according to a second embodiment of the present invention.
Figure 8:
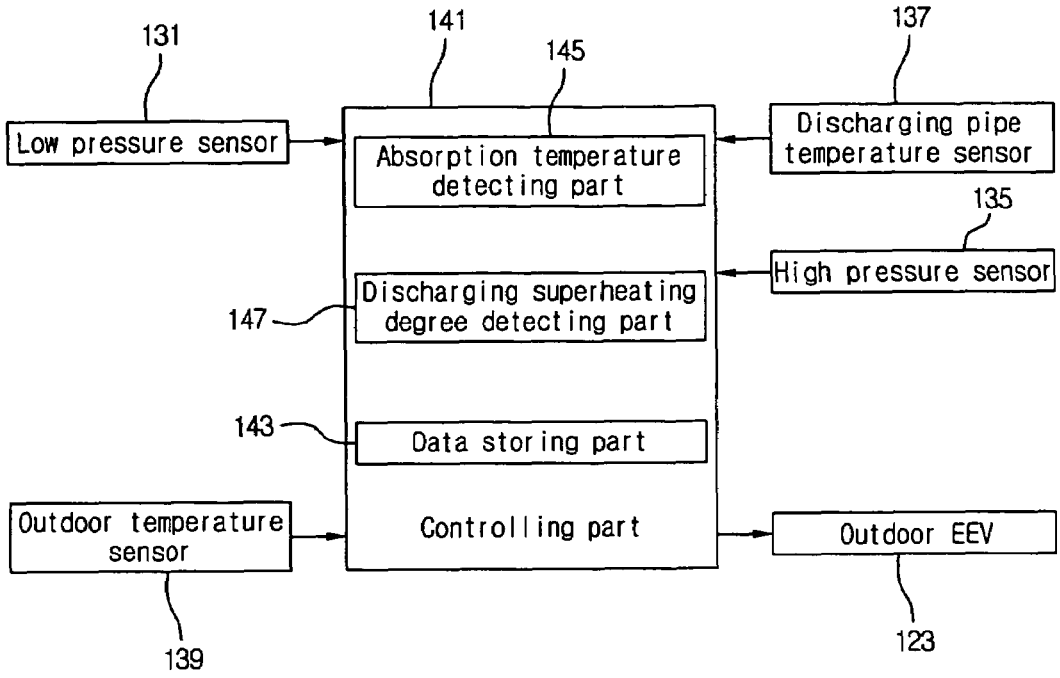
FIG. 8 is a block diagram for controlling a discharging super-heating degree according to the second embodiment of the present invention.

Referring to FIGS. 7 and 8, to the absorption side of the compressor 113, a low pressure sensor 131 is provided and, to the discharging side of the compressor 113, a high pressure sensor 135 and a discharging pipe temperature sensor 137 are provided, respectively.

Also, the controlling part 141 receives a low pressure $P_L$ detected by the low pressure sensor 131, a high pressure detected by the high pressure sensor 135, and a discharging temperature of the compressor 113 from the discharging pipe temperature sensor 137.

Here, the controlling part 141 includes an absorption temperature detecting part 145 and a discharging super-heating degree detecting part 147. The absorption temperature detecting part 145 computes a saturated temperature of the refrigerant used, from the low pressure value of the compressor, received from the low pressure sensor 131, and detects the absorption temperature of the compressor 113 by adding the saturated temperature to the absorption super-heating degree stored in a data storing part 143.

Also, the discharging super-heating degree detecting part 147 detects the discharging super-heating degree as a difference between a temperature at a reversible compression point and a discharging temperature received from the discharging pipe temperature sensor, through the reversible compressing process, from the position of the absorption temperature detected by the absorption temperature detecting part 145.

Figure 9:
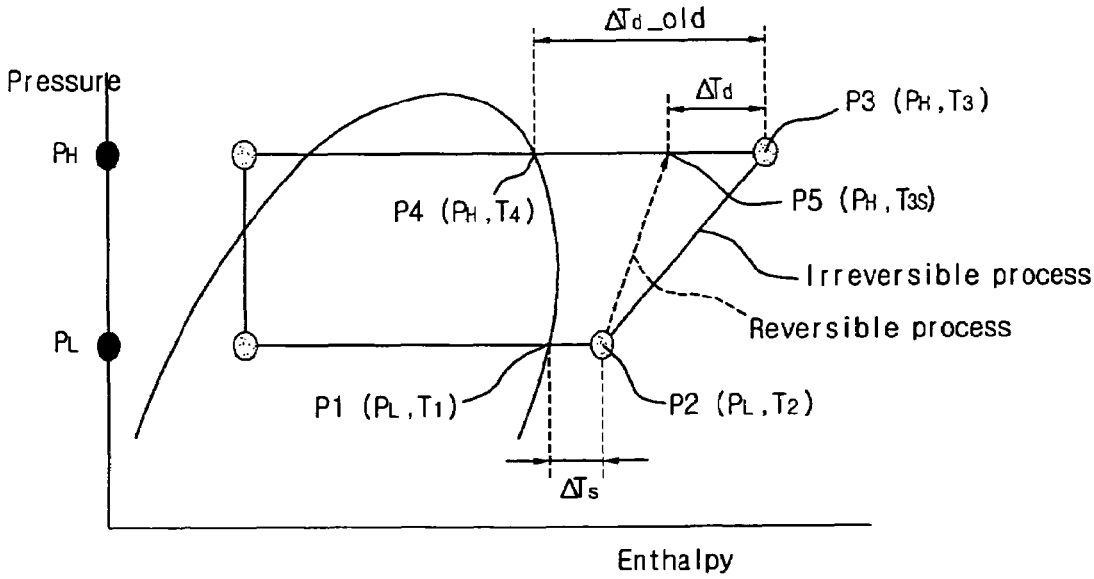
FIG. 9 is a p-h chart for controlling a discharging super-heating degree according to the second embodiment of the present invention.

As shown in FIG. 9, the absorption temperature detecting part 145 computes a saturated temperature T1 of the refrigerant used, using a low pressure detected by the low pressure sensor 131, and measures the absorption temperature T2 at the low pressure by adding a predetermined absorption super-heating degree ΔTs, to the above computed saturated temperature T1 of the refrigerant. At this time, it is possible to compute an absorption point (P2: $P_L$, T2) on the p-h chart of the refrigerant used, using the absorption temperature and the low pressure.

Here, the absorption temperature T2 is obtained by sum of the absorption super-heating degree ΔTs and the saturated temperature of the refrigerant. At this time, the absorption super-heating degree is stored in the data storing part 143 as a temperature value higher as mush as a predetermined temperature than the saturated temperature of the refrigerant at the low pressure side.

And, it is possible to compute a reversible compression point P5, which is a result of the reversible compressing process, from the absorption point P2. At this time, since the compressing process of the actual compressor is the irreversible compressing process (isentropic efficiency <1.0), not the isentropic process, which is the reversible compressing process, the irreversible compression point P3 whose position is higher than the reversible compression point P5 becomes a discharging point of the compressor.

The discharging point of the compressor 113 can be computed with use of the present discharging temperature T3 detected by the discharging pipe temperature sensor 137 and the high pressure $P_H$, and the irreversible compression point P3 of the compressor 113 is detected.

Also, the reversible compression point P5 by the reversible compressing process is obtained from the absorption point P2 obtained from the saturated temperature of the compressor and the absorption super-heating degree, and the discharging super-heating degree ΔTd of the compressor is obtained with use of the difference between the saturated temperature T3*s* at the reversible compression point P5 and the present discharging temperature T3 of the compressor. Such discharging super-heating degree ΔTd becomes the reference for control.

As described above, the discharging super-heating degree ΔTd is controlled with use of a condition for maintaining the refrigerant absorbed to the compressor in the super-heated state. For that purpose, the outdoor EEV 123 (or the outdoor fan) is controlled so that the difference between the temperature T3*s* of the reversible compression point P3 of the compressor and the discharging temperature T3 of the compressor that corresponds to the irreversible compression point P4, may be located in a predetermined range. Therefore, control in which information of both the high pressure part and the low pressure part of the compressor are all included can be performed.

According to the related art, when the discharging super-heating degree ΔTd_old of the compressor is controlled, the high pressure side of the compressor performs control by defining the difference between the saturated temperature T4 of the refrigerant used and the discharging temperature T3 of the refrigerant discharged from the compressor, as the discharging super-heating degree ΔTd_old, but such discharging super-heating degree control is performed with use of the temperature computed from the saturated pressure in high pressure, for reference, therefore, control is performed without consideration of the pressure of the low pressure part and the circulation refrigerant amount, whereby a large error occurs in controlling a super-heating degree.

The foregoing second embodiment controls the discharging super-heating degree based on a computed value of the reversible compression obtained with use of the pressures of the low and high pressure parts on the operation cycle, using the saturated temperature at the low pressure part, the saturated temperature at the high pressure side, and the discharging temperature of the compressor, thereby possibly performing more accurate control, improving the system reliability, compared to a case of controlling the absorption super-heating degree using the sensor (temperature sensor) of same accuracy.

Also, the second embodiment of the present invention controls the discharging super-heating degree using, for reference, the difference between the saturated temperature at the reversible compression point in the low pressure part of the compressor and the present discharging temperature, not the saturated temperature in high pressure, whereby more accurate control of the discharging super-heating degree is possibly performed.

Figure 10:
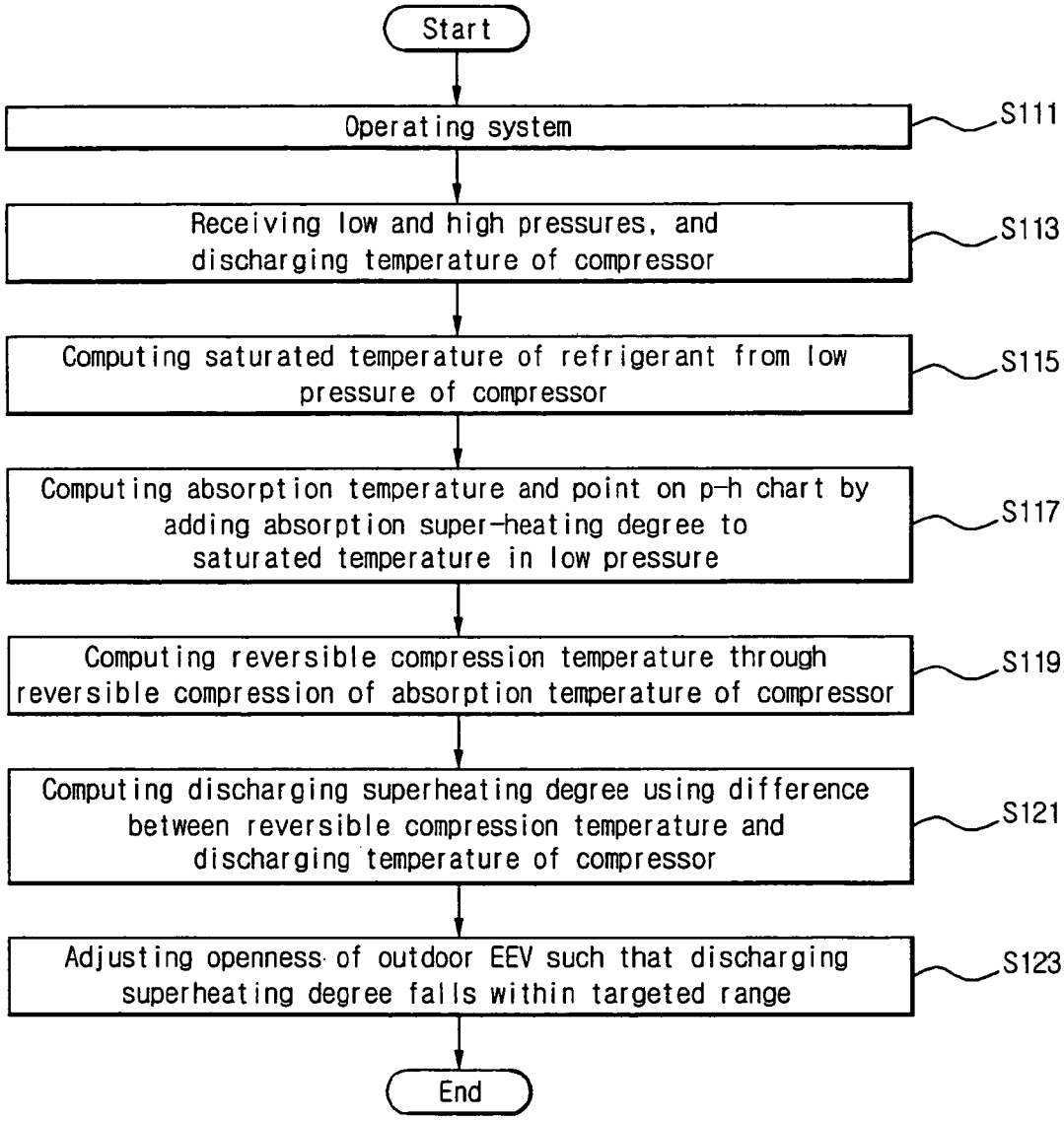
FIG. 10 is a flowchart showing a method for controlling a discharging super-heating degree according to the second embodiment of the present invention.

FIG. 10 shows a method for controlling the discharging super-heating degree of the compressor according to the second embodiment of the present invention.

Referring to FIG. 10, if the heat pump system starts to operate (S111), the system receives a low and a high pressures from the low and the high pressure sensors of the compressor, respectively, and receives a discharging temperature of the compressor from the discharging pipe temperature sensor (S113).

At this time, the saturated temperature of the refrigerant used is computed from the low pressure value measured above, and the absorption point on the p-h chart, is computed with addition of a predetermined absorption super-heating degree, to the above computed saturated temperature at the low pressure side (S115, S117). Here, the absorption point of the compressor is obtained with use of the low pressure and the absorption temperature.

Also, the reversible compression temperature is computed through the reversible compressing process with use of the absorption point of the compressor, for the reference, and the reversible compression point is obtained with use of the reversible compression temperature and the high pressure of the compressor (S119). Here, the reversible compression point is obtained from the reversible compression temperature and the high pressure.

After that, the present discharging super-heating degree is obtained from the difference the reversible compression temperature at the reversible compression point and the discharging temperature of the compressor (S121), and the obtained present discharging super-heating degree is compared to the targeted discharging super-heating degree, then the system is controlled so that the present discharging super-heating degree may fall within the range of the targeted discharging super-heating degree (S123). It is revealed that such method is a super-heating control different from the discharging super-heating degree control of the related art that uses the difference between the saturated temperature in high pressure and the discharging temperature.

Therefore, the openness of the outdoor EEV is controlled so that the present discharging super-heating degree may fall within the targeted range. Namely, if the present discharging super-heating degree is smaller than the targeted discharging super-heating degree range, the openness of the outdoor EEV is reduced and if the present discharging super-heating degree is greater than the targeted discharging super-heating degree range, the openness of the outdoor EEV is increased, whereby the system reliability can be improved, compared to the case of controlling the absorption super-heating degree.

In the meantime, another embodiment of the present invention may simultaneously or selectively control the absorption super-heating degree and the discharging super-heating degree using the first and the second embodiments. Namely, it is possible to control the present absorption super-heating degree to follow the targeted absorption super-heating degree for each outdoor temperature band, and to control the present discharging super-heating degree that corresponds to the temperature difference between the reversible and the irreversible processes, to follow the targeted discharging super-heating degree, on the basis of the absorption discharging super-heating degree. At this time, it may be possible to adjust the openness of the outdoor EEV to the range that satisfies both the absorption and the discharging super-heating degrees when controlling the absorption and the discharging super-heating degrees.

According to a method for controlling the super-heating degree in the heat pump system of the present invention, the targeted absorption super-heating degree is set according to the outdoor temperature so that the refrigerant's state changing depending on the outdoor temperature may be compensated, and the system is controlled so that the present absorption super-heating degree may follow the targeted absorption super-heating degree set in advance, depending on the outdoor temperature, whereby inflow of the liquid refrigerant, to the compressor is minimized.

Also, the present invention controls the discharging super-heating degree that corresponds to the difference between the temperature of the reversible compressing process and the discharging temperature, to remain within the targeted range, after computing the absorption temperature by compensating for the absorption super-heating degree with respect to the saturated temperature computed from the low pressure sensor of the compressor, thereby improving the system reliability through accurate control.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for controlling a super-heating degree in a heat pump system, comprising:

operating the heat pump system;

receiving a low pressure at a low pressure part of a compressor, a high pressure at a high pressure part of the compressor, and a discharging temperature of the compressor;

computing an absorption temperature of the compressor by adding a stored absorption super-heating degree value at the low pressure part to a saturated temperature value of a refrigerant at the low pressure part;

computing a reversible compression point which would result from a reversible compressing process being performed on a refrigerant at the absorption temperature;

computing a present discharging super-heating degree from a difference between a reversible compression temperature at the reversible compression point and the received discharging temperature of the compressor; and controlling the system so that the present discharging super-heating degree of the compressor remains within a predetermined range.

2. The method according to claim 1, wherein the absorption temperature of the compressor at the low pressure side is obtained by computing a saturated temperature of the refrigerant from a low pressure sensor of the compressor and adding an absorption super-heating degree to the computed saturated temperature of the refrigerant.

3. The method according to claim 2, wherein the absorption super-heating degree is a value that satisfies a condition for maintaining the refrigerant absorbed to the compressor in a super-heated state.

4. The method according to claim 2, wherein the absorption super-heating degree is set to a value that is inversely proportional to an outdoor temperature.

5. The method according to claim 1, wherein if the absorption temperature of the compressor is computed, a reversible compressing process is performed with use of a position of the refrigerant used, on a p-h chart, for a starting point, so that the reversible compression point at the high pressure side and the reversible compression temperature at that point are computed.

6. The method according to claim 1, wherein if the present discharging super-heating degree at the high pressure side is not within a predetermined range, an openness of an outdoor EEV (Electronic Expansion Valve) is adjusted.

7. The method according to claim 5, wherein if the present discharging super-heating degree is less than a predetermined targeted range, an openness of an outdoor EEV is reduced, and if the present discharging super-heating degree is greater than a predetermined targeted range, the openness of the outdoor EEV is increased.

8. The method according to claim 1, wherein for control of the discharging super-heating degree of the compressor, data received from an absorption sensor at the low pressure side of the compressor, a high pressure sensor at a high pressure side of the compressor, and a discharging pipe temperature sensor, are used.

9. An apparatus for controlling a super-heating degree in a heat pump system, comprising:

one or more indoor units;

one or more outdoor units each including a compressor, a channel switching valve that selectively switches a channel of a refrigerant depending on cooling and heating modes, an outdoor heat exchanger that exchanges heat with outdoor air, and an outdoor EEV (Electronic Expansion Valve);

low and high pressure sensors that detect a low and a high pressure of the compressor, respectively;

a discharging pipe temperature sensor that detects a discharging temperature of the compressor;

an absorption temperature detector that computes an absorption temperature of the compressor by adding a stored absorption super-heating degree value at a low pressure part to a saturated temperature value of refrigerant at the low pressure part;

a discharging super-heating degree detector that computes a reversible compression temperature which would result from a reversible compressing process being performed on a refrigerant at the absorption temperature, and a discharging temperature at a high pressure part of the compressor, from the absorption temperature of the compressor, and computes a present discharging super-heating degree from a difference between the discharging temperature of the compressor and the reversible compression temperature; and a controller that compares the present discharging super-heating degree computed by the discharging super-heating degree detector, with a targeted discharging super-heating degree set in advance, and controls the system so that the present discharging super-heating degree follows the targeted discharging super-heating degree.

10. The apparatus according to claim 9, wherein the controller adjusts an openness of the outdoor EEV (Electronic Expansion Valve) so that the present discharging super-heating degree is in agreement with the targeted discharging super-heating degree.

11. The apparatus according to claim 10, wherein the controller reduces the openness of the outdoor EEV if the present discharging super-heating degree is less than the targeted discharging super-heating degree, and increases the openness of the outdoor EEV if the present discharging super-heating degree is greater than the targeted discharging super-heating degree.

12. The apparatus according to claim 9, wherein the absorption super-heating degree is set to a high value as an outdoor temperature is low.

13. The apparatus according to claim 9, wherein the controller reduces an openness of an outdoor EEV (Electronic Expansion Valve) if an outdoor temperature is low and increases the openness of the outdoor EEV if the outdoor temperature is high.

14. The apparatus according to claim 9, wherein the controller adjusts an openness of an outdoor EEV (Electronic Expansion Valve) within a range that satisfies both the absorption super-heating degree and the discharging super-heating degree.

* * * * *